US005227082A

United States Patent [19]

Pillon et al.

[11] Patent Number: 5,227,082

[45] Date of Patent: Jul. 13, 1993

[54] LUBRICATING OIL HAVING IMPROVED RUST INHIBITION AND DEMULSIBILITY

[75] Inventors: Lilianna Z. Pillon, Sarnia; Andre E. Asselin, Forest, both of Canada

[73] Assignee: Exxon Research and Engineering Company, Florham Park, N.J.

[21] Appl. No.: 812,784

[22] Filed: Dec. 23, 1991

[51] Int. Cl.[5] ..... C10M 141/02; C10M 141/06

[52] U.S. Cl. ..... 252/50; 252/51.5 R; 252/56 R; 252/390; 252/392

[58] Field of Search ..... 252/50, 390, 51.5 R, 252/56 R, 392

[56] References Cited

U.S. PATENT DOCUMENTS

| | | | |
|---|---|---|---|
| 2,560,898 | 7/1951 | Schulze | 44/63 |
| 2,779,740 | 2/1957 | Messina | 252/51.5 |
| 3,066,097 | 11/1962 | Jones | 252/8.55 |
| 3,254,025 | 5/1966 | LeSuer | 252/32.7 |
| 3,260,538 | 7/1966 | Gardner | 252/391 |
| 3,368,971 | 2/1968 | Retzloff et al. | 252/33.4 |
| 3,390,082 | 6/1968 | LeSuer et al. | 252/32.7 |
| 3,408,297 | 10/1968 | Sheldahl | 252/33.3 |
| 3,907,578 | 9/1975 | Scherrer | 252/390 |
| 3,931,022 | 1/1976 | Chesiuk et al. | 252/47.5 |
| 4,081,385 | 3/1978 | Yamamoto et al. | 252/32.7 |
| 4,165,292 | 8/1979 | Davis et al. | 252/51.5 |
| 4,280,894 | 7/1981 | Taylor | 44/72 |
| 4,330,302 | 5/1982 | Taylor | 44/63 |
| 4,409,000 | 10/1983 | LeSuer | 44/70 |
| 4,493,776 | 1/1985 | Rhodes | 252/25 |
| 4,725,373 | 2/1988 | Treybig | 252/392 |
| 4,740,320 | 4/1988 | Treybig | 252/390 |

*Primary Examiner*—Jacqueline V. Howard
*Attorney, Agent, or Firm*—John W. Ditsler; James H. Takemoto

[57] ABSTRACT

The rust inhibiting and demulsibility performance of a lubricating oil can be synergistically enhanced by incorporating a rust inhibitor having at least one COOH acid group and a particular class of pyridine derivatives.

8 Claims, No Drawings

LUBRICATING OIL HAVING IMPROVED RUST INHIBITION AND DEMULSIBILITY

BACKGROUND OF THE INVENTION

1. Field of the Invention

This invention concerns the use of a synergistic combination of a rust inhibitor containing at least one COOH group and particular derivatives of pyridine.

2. Description of Related Art

Many lubricating oils require the presence of rust inhibitors to inhibit or prevent rust formation, which often occurs due to water contacting a metal surface. However, we have found that the oil/water interfacial tension decreases with increasing concentration of the rust inhibitor. Therefore, although rust inhibition is improved, the demulsibility of the lubricating oil is degraded. Accordingly, it would be desirable to have a simple yet convenient means to obtain effective rust inhibition while reducing any adverse effect on the demulsibility of the oil.

SUMMARY OF THE INVENTION

In one embodiment, this invention concerns a lubricating oil capable of inhibiting rust formation which comprises a major amount of a lubricating oil basestock and a synergistic additive combination comprising (a) a rust inhibiting amount of a rust inhibitor having at least one COOH acid group, and (b) a pyridine derivative having the formula

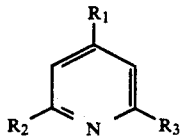

where $R_1$, $R_2$, and $R_3$ are independently hydrogen or an alkyl group containing from 1 to 3 carbon atoms, wherein the weight ratio of (b) to (a) is greater than zero and less than about 0.06:1.

In another embodiment, this invention concerns a method for inhibiting rust formation in an internal combustion engine by lubricating the engine with the oil described above.

DETAILED DESCRIPTION OF THE INVENTION

This invention requires a major amount of a lubricating oil basestock and a minor amount of a synergistic combination of an oil soluble rust inhibitor containing at least one COOH group and a particular pyridine derivative.

The lubricating oil basestock can be derived from natural lubricating oils, synthetic lubricating oils, or mixtures thereof. Suitable lubricating oil basestocks also include basestocks obtained by isomerization of synthetic wax and slack wax, as well as hydrocrackate basestocks produced by hydrocracking (rather than solvent extracting) the aromatic and polar components of the crude. In general, the lubricating oil basestock will have a kinematic viscosity ranging from about 5 to about 10,000 cSt at 40° C., although typical applications will require an oil having a viscosity ranging from about 10 to about 1,000 cSt at 40° C.

Natural lubricating oils include animal oils, vegetable oils (e.g., castor oil and lard oil), petroleum oils, mineral oils, and oils derived from coal or shale.

Synthetic oils include hydrocarbon oils and halo-substituted hydrocarbon oils such as polymerized and interpolymerized olefins (e.g. polybutylenes, polypropylenes, propylene-isobutylene copolymers, chlorinated polybutylenes, poly(1-hexenes), poly(1-octenes), poly(1-decenes), etc., and mixtures thereof); alkylbenzenes (e.g. dodecylbenzenes, tetradecylbenzenes, dinonylbenzenes, di(2-ethylhexyl)benzene, etc.); polyphenyls (e.g. biphenyls, terphenyls, alkylated polyphenyls, etc.); alkylated diphenyl ethers, alkylated diphenyl sulfides, as well as their derivatives, analogs, and homologs thereof; and the like.

Synthetic lubricating oils also include alkylene oxide polymers, interpolymers, copolymers and derivatives thereof wherein the terminal hydroxyl groups have been modified by esterification, etherificatoin, etc. This class of synthetic oils is exemplified by polyoxyalkylene polymers prepared by polymerization of ethylene oxide or propylene oxide; the alkyl and aryl ethers of these polyoxyalkylene polymers (e.g., methyl-polyisopropylene glycol ether having an average molecular weight of 500–1000, diethyl ether of polypropylene glycol having a molecular weight of 1000–1500); and mono- and poly- carboxylic esters thereof (e.g., the acetic acid esters, mixed $C_3$–$C_8$ fatty acid esters, and $C_{13}$ oxo acid diester of tetraethylene glycol).

Another suitable class of synthetic lubricating oils comprises the esters of dicarboxylic acids (e.g., phthalic acid, succinic acid, alyl succinic acids and alkenyl succinic acids, maleic acid, azelaic acid, suberic acid, sebasic acid, fumaric acid, adipic acid, linoleic acid dimer, malonic acid, alkylmalonic acids, alkenyl malonic acids, etc.) with a variety of alcohols (e.g., butyl alcohol, hexyl alcohol, dodecyl alcohol, 2-ethylhexyl alcohol, ethylene glycol, diethylene glycol monoether, propylene glycol, etc.). Specific examples of these esters include dibutyl adipate, di(2-ethylhexyl) sebacate, di-n-hexyl fumarate, dioctyl sebacate, diisooctyl azelate, diisodecyl azelate, dioctyl phthalate, didecyl phthalate, dieicosyl sebacate, the 2-ethylhexyl diester of linoleic acid dimer, and the complex ester formed reacting one mole of sebacic acid with two moles of tetraethylene glycol and two moles of 2-ethylhexanoic acid, and the like.

Esters useful as synthetic oils also include those made from $C_5$ to $C_{12}$ monocarboxylic acids and polyols and polyol ethers such as neopentyl glycol, trimethylolpropane, pentaerythritol, dpentaerylthritol, tripentaerythritol, and the like.

Silicon-based oils (such as the polyalkyl-, polyaryl-, polyalkoxy-, or polyaryloxy-siloxane oils and silicate oils) comprise another useful class of synthetic lubricating oils. These oils include tetra-ethyl silicate, tetraisopropyl silicate, tetra-(2-ethylhexyl) silicate, tetra-(4-methyl-2-ethylhexyl) silicate, tetra(p-tert-butyphenyl) silicate, hexa-(4-methyl-2-pentoxy)-disiloxane, poly(methyl)-siloxanes and poly(methylphenyl) siloxanes, and the like. Other synthetic lubricating oils include liquid esters of phosphoruscontaining acids (e.g., tricresyl phosphate, trioctyl phosphate, diethyl ester of decylphosphonic acid), polymeric tetrahydrofurans, polyalphaolefins, and the like.

The lubricating oil may be derived from unrefined, refined, rerefined oils or mixtures thereof. Unrefined oils are obtained directly from a natural source of synthetic source (e.g., coal, shale, or tar sands bitumen) without further purification or treatment. Examples of unrefined oils include a shale oil obtained directly from a retorting operation, a petroleum oil obtained directly from distillation, or an ester oil obtained directly from an esterification process, each of which is then used without further treatment. Refined oils are similar to the unrefined oils except that refined oils have been treated in one or more purification steps to improve one or more properties. Suitable purification techniques include distillation, hydrotreating, dewaxing, solvent extraction, acid or base extraction, filtration, and percolation, all of which are known to those skilled in the art. Rerefined oils are obtained by treating used oils in processes similar to those used to obtain the refined oils. These rerefined oils are also known as reclaimed or reprocessed oils and often are additionally processed by techniques for removal of spent additives and oil breakdown products.

The oil soluble rust inhibitor must be acidic—that is, must contain at least one COOH acid group—and can contain essentially any acid group, including carboxylic, succinic, sulfonic acid groups, and the like. A particularly preferred rust inhibitor is one containing a major amount (preferably at least 70 wt. %) of a succinic acid derivative of the formula

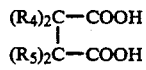

and a minor amount (preferably less than 30 wt. %) of a partially esterified alkyl succinic acid of the formula

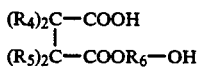

where $R_4$, $R_5$, and $R_6$ are each an alkyl group. The alkyl group may be linear or branched, with linear being preferred. If there are too few carbon atoms in each of $R_4$, $R_5$, and $R_6$, the inhibitor will be very soluble but cannot absorb on the metal surface to prevent rust. In contrast, if there are too many carbon atoms in each of $R_4$, $R_5$, and $R_6$, the inhibitor will not be sufficiently oil soluble. Accordingly, to ensure that $R_4$, $R_5$, and $R_6$ can be oil soluble and impart rust inhibition to the lubricating oil, $R_4$, $R_5$, and $R_6$ should each contain from about 2 to about 10, preferably from about 3 to about 6, and most preferably from about 3 to about 4, carbon atoms. $R_4$, $R_5$, and $R_6$ may be the same or different and saturated or unsaturated. Most preferably, $R_4$ and $R_5$ will each be $CH_3$-CH=CH, and $R_6$ will be $(CH_2)_3$.

The particular pyridine derivative used in this invention has the formula

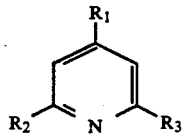

(1)

where $R_1$, $R_2$, and $R_3$ are independently hydrogen or an alkyl group containing from 1 to 3 carbon atoms. If alkyl, each may be saturated or unsaturated, with saturation being preferred. Most preferably, $R_1$–$R_3$ will each be a methyl group (i.e., collidine).

The amount of rust inhibitor used in the additive combination added need only be an amount that is necessary to impart rust inhibition performance to the oil; i.e. a rust inhibiting amount. Broadly speaking, this corresponds to using at least about 0.03 wt. % of the inhibitor. However, the minimum amount required will vary with the particular feedstock. For example, high viscosity basestocks such as 1400 Neutral or higher base oils will require at least 0.1 wt. % or more, while most other lower viscosity basestocks (such as 150 to 600 Neutral) require at least 0.03–0.04 wt. %. Although not necessary, an amount of the inhibitor in excess of the minimum amount required could be used if desired.

The relative amount of the rust inhibitor and pyridine derivative is important. To pass the ASTM D665B rust test, the weight ratio of pyridine derivative to rust inhibitor should be greater than zero and less than about 0.06:1, preferably less than about 0.04:1, and most preferably 0.02:1 or less.

As shown in the following examples, the rust inhibitors and pyridine derivatives suitable for use in this invention are commercially available. As such, so are their methods of preparation.

If desired, other additives known in the art may be added to the lubricating base oil. Such additives include dispersants, antiwear agents, antioxidants, corrosion inhibitors, detergents, pour point depressants, extreme pressure additives, viscosity index improvers, friction modifiers, and the like. These additives are typically disclosed, for example, in "Lubricant Additives" by C. V. Smalhear and R. Kennedy Smith, 1967, pp. 1–11 and in U.S. Pat. No. 4,105,571, the disclosures of which are incorporated herein by reference.

A lubricating oil containing the synergistic additive combination described above can be used in essentially any application where rust inhibition is required. Thus, as used herein, "lubricating oil"(or "lubricating oil composition") is meant to include automotive crankcase lubricating oils, industrial oils, gear oils, transmission oils, and the like. In addition, the lubricating oil composition of this invention can be used in the lubrication system of essentially any internal combustion engine, including automobile and truck engines, two-cycle engines, aviation piston engines, marine and railroad engines, and the like. Also contemplated are lubricating oils for gas-fired engines, alcohol (e.g. methanol) powered engines, stationary powered engines, turbines, and the like.

This invention may be further understood by reference to the following examples, which include a preferred embodiment of the invention. In the examples, the rust protection and oil/water interfacial tension were measured using ASTM Test Methods D665B and D971-82, respectively, the disclosures of which are incorporated herein by reference. The oil/water demulsibility was measured by ASTM Test D 1401-84, the disclosure of which is also incorporated herein by reference.

EXAMPLE 1

Properties of Base Oils Tested

The properties of the base oils tested in the following examples are shown in Table 1 below.

TABLE 1

| Base Oils | A(1) | B(2) | C(3) | D(4) | E(5) | F(6) |
|---|---|---|---|---|---|---|
| Viscosity, cSt | | | | | | |
| @ 40° C. | 29.7 | 29.5 | 111.4 | 105.9 | 32.7 | 30.4 |
| @ 100° C. | 5.1 | 5.0 | 11.6 | 11.3 | 5.6 | 5.8 |
| Viscosity Index | 96 | 94 | 89 | 92 | 106 | 134 |
| Hydrocarbon Analysis, wt % | | | | | | |
| Saturates | 86.1 | 82.8 | 80.4 | 80.5 | >99.5 | >99.5 |
| Aromatics/Polars | 13.9 | 17.2 | 19.6 | 19.5 | <0.5 | <0.5 |
| Nitrogen, ppm | | | | | | |
| Total | 36 | 8 | 100 | 30 | <1 | <1 |
| Basic | 33 | 4 | 88 | 16 | 0 | 0 |
| Sulfur, wt % | 0.06 | 0.09 | 0.11 | 0.12 | <1 ppm | <1 ppm |
| Distillation, °C. | | | | | | |
| Initial BP | 324 | 334 | 370 | 362 | 340 | 408 |
| Mid BP | 418 | 418 | 488 | 488 | 433 | 481 |
| Final BP | 526 | 513 | 587 | 598 | 533 | 596 |

(1) A conventional 150 Neutral NMP extracted base oil which is then solvent dewaxed and hydrofinished.
(2) A conventional 150 Neutral phenol extracted base oil which is then solvent dewaxed and hydrofinished.
(3) A conventional 600 Neutral NMP extracted base oil which is then solvent dewaxed and hydrofinished.
(4) A conventional 600 Neutral phenol extracted base oil which is then solvent dewaxed and hydrofinished.
(5) A white oil obtained by high pressure hydrogenation to saturate aromatics and remove essentially any sulfur and nitrogen from conventional base oils.
(6) A polyalphaolefin sythetic base oil obtained by polymerizing a $C_{10}$ monomer to form a mixture of three components: $C_{10}$ trimer ($C_{30}$), $C_{10}$ tetramer ($C_{40}$), and $C_{10}$ pentamer ($C_{50}$).

EXAMPLE 2

Minimum Amount of Rust Inhibitor Required Varies

Rust performance tests were performed on base oils A-E from Example 1 to determine the minimum concentration of Lz 859 (a commercial rust inhibitor available from The Lubrizol Corporation) required to pass ASTM Test D665B. This inhibitor is a mixture of about 74.5 wt. % unreacted tetrapropenyl succinic acid of the formula $$\begin{array}{l}(CH_3{-}CH{=}CH)_2C{-}COOH\\ \quad\quad\quad\quad\quad\;\;|\\ (CH_3{-}CH{=}CH)_2C{-}COOH\end{array} \qquad (2)$$

and about 25.5 wt. % of a partially esterified alkyl succinic acid of the formula $$\begin{array}{l}(CH_3{-}CH{=}CH)_2C{-}COOH\\ \quad\quad\quad\quad\quad\;\;|\\ (CH_3{-}CH{=}CH)_2C{-}COO(CH_2)_3{-}OH\end{array} \qquad (3)$$

which is obtained by reacting (2) with $HO{-}(CH_2)_3{-}OH$. The results of these tests are shown in Table 2 below.

TABLE 2

| Base Oil | Minimum wt. % Lz 859 to Pass ASTM D665B |
|---|---|
| A | <0.03 |
| B | 0.04 |
| C | <0.03 |
| D | 0.05 |
| E | 0.10 |

The data in Table 2 show that the minimum amount of Lz 859 required to pass ASTM Test D6675B varies with the base oil tested. In particular, the data show that higher nitrogen content base oils (NMP extracted base oils A and C) require less Lz 859 than equivalent viscosity grade phenol extracted base oils.

EXAMPLE 3

Rust Performance of Lz 859 in White Oil

The rust performance, oil/water interfacial tension, and demulsibility of oil E from Example 1 was tested at variuos concentrations of Lz 859. The results of these tests are shown in Table 3 below:

TABLE 3

| Lz 859 wt. % | IT mN/m | Rust Performance (1) | Demulsibility (2) |
|---|---|---|---|
| 0 | 45.1 | Fail - 7 | 24/39/17 |
| 0.03 | 19.0 | Fail - 7 | |
| 0.04 | 16.0 | Fail - 7 | |
| 0.05 | 13.5 | Fail - 7 | 15/23/42 |
| 0.07 | 11.9 | Fail - 4 | |
| 0.08 | 11.4 | Fail - 4 | |
| 0.09 | 10.9 | Fail - 2 | |
| 0.10 | 9.3 | Pass - 0 | 3/7/70 |

(1) Numbers after pass/fail indicate rust performance - 0 indicates no rust while 8 indicates that whole metal surface is covered.
(2) Oil/water/emulsion in milliliters after 1 minute.

The data in Table 3 show that oil/water interfacial tension and demulsibility degrade with increasing concentrations of Lz 859. Thus, although effective rust performance can be obtained using 0.1 wt. % Lz 859, the oil/water interfacial tension and demulsibility are poor.

EXAMPLE 4

Rust Performance of Collidine in White Oil

The rust performance of oil E containing various amounts of 2,4,6-trimethyl pyridine (i.e. colline—formula (1) above in which $R_1=R_2=R_3=CH_3$) was determined. The results of these tests are shown in Table 4 below

TABLE 4

| Collidine ppm Nitrogen | Rust Performance |
|---|---|
| 0 | Fail |
| 5 | Fail |
| 11 | Fail |
| 47 | Fail |
| 93 | Fail |

The data in Table 4 show that collidone alone does not inhibit rust.

EXAMPLE 5

Rust Performance Using Lz 859 and Two Pyridine Derivatives in White Oil

Rust performance tests were performed on two samples of oil E containing Lz 859 with 2,6-di-tert-butylpyridine and 2,4,6-trimethyl pyridine (collidine). The results of these tests are shown in Table 5 below.

TABLE 5

| Pyridine Derivative | Nitrogen ppm | Rust Performance at Various wt. % Lz 859 | | |
|---|---|---|---|---|
| | | 0.03 | 0.04 | 0.05 |
| 2,6-di-tert-butylpyridine | 7 | Fail | Fail | Fail |
| Collidine | 5 | Fail | Pass | — |

The data in Table 5 show 2,6-di-tert-butyl pyridine did not improve the effectiveness of Lz 859 as a rust inhibitor. In contrast, the presence of collidine did.

EXAMPLE 6

Rust Performance and Interfacial Tension of 150N and 600N Basestocks Using Combination of Lz 859 and Collidine The rust performance and interfacial tension (IT) for oils B and D were determined using various concentrations of collidine and Lz 859. The results of these tests are shown in Table 6 below.

TABLE 6

| Base Oil | Lz 859 wt. % | Collidine ppm Nitrogen | IT mN/m | Rust Performance |
|---|---|---|---|---|
| Oil B | 0 | 0 | 43.1 | Fail |
| Oil B | 0.03 | 0 | 16.6 | Fail |
| Oil B | 0.04 | 0 | 15.8 | Pass |
| Oil B | 0.03 | 22 (1) | 20.7 | Pass |
| Oil D | 0 | 0 | 42.8 | Fail |
| Oil D | 0.04 | 0 | 21.4 | Fail |
| Oil D | 0.05 | 0 | 13.4 | Pass |
| Oil D | 0.04 | 5 (2) | 20.9 | Pass |
| Oil D | 0.04 | 50 (3) | (4) | Fail |

(1) Total nitrogen present is 30 ppm.
(2) Total nitrogen present is 35 ppm.
(3) Total nitrogen present is 80 ppm.
(4) Not tested.

The data in Table 6 show that the 150N base oil (oil B) requires 0.04 wt. % Lz 859 to pass the rust test, and that the interfacial tension of this blend is 15.8 mN/m. After increasing the nitrogen content from 8 (see Table 1) to 30 ppm due to the addition of collidine, the amount of Lz 859 required to pass the rust test decreases from 0.04 to 0.03 wt. %, and oil B passes the rust test at a higher interfacial tension (20.7 mN/m). The higher viscosity 600N base oil (oil D) required only an increase in total nitrogen content from 30 (see Table 1) to 35 ppm to decrease the amount of rust inhibitor required from 0.05 to 0.04 wt. %., and passed the rust test at a higher interfacial tension (20.9 mN/m). The data also show that the pyridine derivative/rust inhibitor combination was not effective at a weight ratio of 0.08:1.

EXAMPLE 7

Pyridine Derivative/Rust Inhibitor Weight Ratio Important

A series of tests were performed using oil F containing 0.05 wt. % Lz 859 to which various amounts of collidine were added. The results of these tests are shown in Table 7 below.

TABLE 7

| Lz 859 wt. % | Collidine ppm Nitrogen | wt ratio Collidine/Lz 859 | Rust Performance (1) |
|---|---|---|---|
| 0.05 | 0 | 0 | Fail - 8 |
| 0.05 | 10 | 0.02 | Pass - 0 |
| 0.05 | 30 | 0.06 | Fail - 7 |
| 0.05 | 50 | 0.10 | Fail - 8 |

(1) See footnote (1) in Table 3.

The data in Table 7 show that the additive combination of this invention is an effective rust inhibitor when the weight ratio of the pyridine derivative to the rust inhibitor is greater than zero and less than about 0.06:1, most preferably about 0.02:1 or less.

What is claimed is:

1. A lubricating oil which comprises a major amount of a lubricating oil basestock and a synergistic additive combination comprising (a) a rust inhibiting amount of a rust inhibitor wherein the rust inhibitor contains a succinic acid derivative of the formula

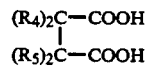

and partially esterified alkyl succinic acid of the formula

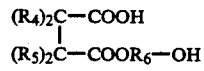

where $R_4$, $R_5$, and $R_6$ may be the same or different and are each an alkyl group containing from about 2 to about 10 carbon atoms, and (b) a pyridine derivative having the formula

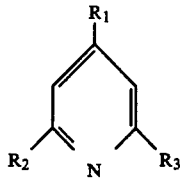

where $R_1$, $R_2$, and $R_3$ are independently an alkyl group containing from 1 to 3 carbon atoms, wherein the weight ratio of (b) to (a) is greater than zero and less than about 0.06.

2. The oil of claim 1 wherein at least one of $R_1$, $R_2$, or $R_3$ is $CH_3$.

3. The oil of claim 2 wherein $R_1$, $R_2$, and $R_3$ are each $CH_3$.

4. The oil of claim 1 wherein the rust inhibitor contains a major amount of the succinic acid derivative and a minor amount of the partially esterified alkyl succinic acid.

5. The oil of claim 4 wherein the rust inhibitor contains at least 70 wt. % of the succinic acid derivative.

6. The oil of claim 5 wherein the succinic acid derivative is tetrapropenyl succinic acid.

7. The oil of claim 1 wherein at least 0.03 wt. % of the combination is present therein.

8. A method for inhibiting the formation of rust in an internal combustion engine which comprises lubricating the engine with the oil of claim 1.

* * * * *